United States Patent [19]

Philip, Jr.

[11] Patent Number: 4,603,104

[45] Date of Patent: Jul. 29, 1986

[54] SUPERSENSITIZATION OF SILVER HALIDE EMULSIONS

[75] Inventor: James B. Philip, Jr., St. Paul, Minn.

[73] Assignee: Minnesota Mining and Manufacturing Company, St. Paul, Minn.

[21] Appl. No.: 740,234

[22] Filed: May 31, 1985

[51] Int. Cl.[4] ..... G03C 1/20; G03C 1/28

[52] U.S. Cl. ..... 430/572; 430/542; 430/570; 430/576; 430/584; 430/615; 430/627; 430/631; 430/634

[58] Field of Search ..... 430/542, 572, 570, 584, 430/634, 631, 615, 576, 627

[56] References Cited

U.S. PATENT DOCUMENTS

| | | | |
|---|---|---|---|
| 3,457,078 | 7/1969 | Riester | 96/104 |
| 3,525,620 | 8/1970 | Nishio et al. | 430/631 |
| 3,637,393 | 1/1972 | Sakamoto et al. | 96/109 |
| 3,695,888 | 10/1972 | Hiller et al. | 96/123 |
| 4,212,672 | 7/1980 | Mihara et al. | 430/494 |
| 4,513,081 | 4/1985 | Okazaki et al. | 430/572 |
| 4,515,888 | 5/1985 | Beretta et al. | 430/584 |

*Primary Examiner*—Mary F. Downey

*Attorney, Agent, or Firm*—Donald M. Sell; James A. Smith; Mark A. Litman

[57] ABSTRACT

Combinations of supersensitizers for photographic emulsions have been found which provide increased speed.

29 Claims, No Drawings

SUPERSENSITIZATION OF SILVER HALIDE EMULSIONS

BACKGROUND OF THE INVENTION

1. Field of the Invention

This invention relates to the use of supersensitizers in photographic emulsions.

2. Background of the Art

In most uses of silver halide in photographic materials, it is desirable to increase the speed or sensitivity of the emulsion. There are a number of different techniques for increasing the speed of an emulsion which are usually classified as chemical sensitization or spectral sensitization. Chemical sensitization usually involves modification of the silver halide grains to make the most efficient use of the radiation that they absorb. The three general types of chemical sensitization are sulfur sensitization, reduction sensitization, and precious (noble) metal sensitization. These methods of chemical sensitization are well known and firmly established in the art (e.g., James, T. H. and Vanselow, W. "Chemical Sensitization", J. Photo. Sci., 1, 133 (1953), Freiser, H. and Ranz, E., Ber der Bunsengesellschaft, 68, 389 (1964), and Pouradier, J. "Chemical Sensitization", Photographic Theory: Liege Summer School, A. Hautot, p. 111, Focal Press (London 1963).

Spectral sensitization enables grains to benefit from radiation in regions of the electromagnetic spectrum where the silver halide would ordinarily not absorb. Dyes which absorb radiation and can transfer energy to the grains to help in the photoreduction of silver ions to clusters of silver metal are conventionally used to effect spectral sensitization.

Another phenomenon associated with the use of spectral sensitizing dyes is known in the art as supersensitization. The addition of other substances, frequently in quantities ranging from an equivalent molar rate to a 100 fold molar excess of supersensitizer to dye, can increase the spectrally sensitized speed of the emulsion by more than an order of magnitude. Some supersensitizers are dyes themselves, but many others do not absorb radiation in significant amounts in the visible portion of the electromagnetic spectrum. Therefore, the effect of supersensitizers on spectral sensitization is not clearly dependent on the ability of compounds to absorb radiation in the visible portion of the spectrum. Certain cyanines, merocyanines compounds analogous to cyanines, certain acylmethylene derivatives of heterocyclic bases, and ketone derivatives such as p-dimethylaminobenzalacetone are known supersensitizers. An expanded selection of supersensitizers is therefore desired.

Mercaptotetrazoles are generally taught in U.S. Pat. Nos. 2,403,977; 3,266,897; and 3,397,987.

U.S. Pat. No. 3,457,078 describes the use of mercapto substituted oxazine, oxazole, thiazole, thiodiazole, imidazole or tetrazole as supersensitizers in combination with certain cyanine dyes.

U.S. Pat. No. 3,637,393 describes the use of mercaptotetrazoles in combination with certain hydroquinone compounds to reduce fog and increase speed in photographic emulsions.

The effects of supersensitizers are generally not additive as only so much speed increase can be obtained by the addition of speed enhancing compounds to silver halide emulsions. Each material needed usually is met by an effect more stringent than diminishing returns. In almost all cases multiple supersensitizers have been found to be limited to the maximum speed increase of a single supersensitizer. That is, the speed increase provided by combinations of supersensitizers is almost always no greater than that provided by the strongest supersensitizer.

BRIEF DESCRIPTION OF THE INVENTION

Combinations of supersensitizers and combinations of supersensitizers with certain photographic adjuvants have been found to increase the speed of photographic emulsions to a degree much greater than that expected by one skilled in the art. Most combinations of these materials are at least additive, which is in and of itself a surprising result based on knowledge of limitations of the contributions of multiple supersensitizers. Some combinations are even synergistic, providing more than additive speed increases.

DETAILED DESCRIPTION OF THE INVENTION

Combinations of certain materials have been found to be highly efficient supersensitizers for spectrally sensitized silver halide photographic emulsions. The four combinations of materials which have been found to provide unique levels of supersensitization to photographic emulsions are:

(1) Arylmercaptotetrazoles and bis(triazine-2-ylamino)stilbenes, (2) Arylmercaptotetrazoles and poly(ethylacrylate), (3) Poly(ethylacrylate) and bis(triazine-2-ylamino)-stilbenes and (4) Arylmercaptotetrazoles, bis(triazine-2-ylamino)-stilbenes and poly(ethylacrylate).

The arylmercaptotetrazoles useful in the practice of the present invention are defined by the formula

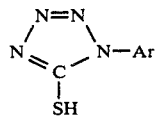

in which Ar is an aryl group, preferably a phenyl group. The aryl or phenyl group may or may not be substituted as with alkyl, alkoxy, phenyl, fused benzyl (to form naphthyl groups), halogen (e.g., chloro-, bromo-, fluoro- and iodo-), amino, sulfonic acid, and carboxyl groups as described in U.S. Pat. No. 3,457,078. The term phenyl includes substituted phenyl unless specifically stated to be unsubstituted in describing the mercaptotetrazoles.

The bis(triazine-2-ylamino)stilbenes may be represented by the formula

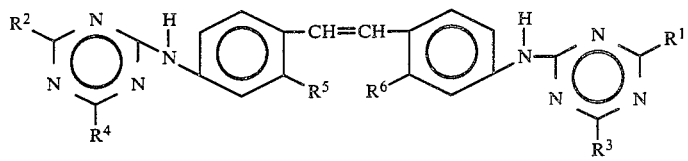

in which $R^1$, $R^2$, $R^3$ and $R^4$ each represents a hydrogen atom, or a substituent group, such as hydroxyl, aryloxyl (e.g., phenoxyl, o-toloxyl, p-sulfophenoxyl, etc.), alkoxyl (e.g., methoxyl, ethoxyl, etc.), a halogen atom (e.g., chlorine, bromine, etc.), a heterocyclic radical (e.g., morpholinyl, piperidyl, etc.), an alkylthio group (e.g., methylthio, ethylthio, etc.), an arylthio group (e.g., phenylthio, tolylthio, etc.), a heterocyclicthio group (e.g., benzothiazylthio, etc.), an amino group, an alkylamino group (e.g., methylamino, ethylamino, propylamino, dimethylamino, diethylamino, dodecylamino, cyclohexylamino, β-hydroxyethylamino, di-β-hydroxyethylamino, β-sulfoethylamino, etc.), an arylamino group (e.g., anilino, o-, m-, and p-sulfoanilino, o-, m-, and p-chloroanilino, o-, m-, and p-anisylamino, o-, m-, and p-toludino, o-,m- and p-carboxyanilino, hydroxyanilino, sulfonaphthylamino, o-, m-, and p-aminoanilino, p-acetamidoanilino, etc.), etc., and $R^5$ and $R^6$ each represents a hydrogen atom or a water-solubilizing group, such as phosphino, sulfo, carboxyl, etc. (as well as alkali metal or amino salts of such groups).

Preferably $R^1$ and $R^2$ are H, OH, COOH, and amino, $R^3$ and $R^4$ are amino, preferably anilino (with the phenyl thereof optionally substituted with alkyl, alkoxy, halogen, amino, sulfonic acid, and carboxyl), and $R^5$ and $R^6$ are acid, water-solubilizing groups such as carboxylic acid and its alkali metal salts or sulfonic acid and its alkali metal salts.

The compounds of the present invention may be added in any effective supersentizing amount to the photographic emulsion. The concentration of ingredients and materials can vary significantly in photographic emulsions such as from 0.5 to 10 g/m$^2$ for silver. The supersensitizers may also vary significantly in concentration. A generally useful range would be from 0.001 to 0.5 percent by dry weight of each component in the supersensitizer combination of the total silver halide emulsion layer. This would generally comprise about 0.01 to 50% by weight of the silver halide in the photographic emulsion layer. A more preferred range would be from 0.1 to 5% for the total supersensitizer combination by weight of the silver halide or about 0.01 to 0.5% total dry weight of the coated emulsion layer.

Any spectral sensitizing dye and any infrared spectral sensitizing dye may be used in the practice of the present invention with the supersensitizing compounds of the present invention. Useful dyes for this purpose tend to be merocyanines, cyanines and especially tricarbocyanines. Such dye sensitizers for the infrared are described for example in U.S. Pat. Nos. 3,457,078, 3,619,154, 3,682,630, 3,690,891, 3,695,888, 4,030,932 and 4,367,800. The preferred classes of compounds are the tricarbocyanines such as the 3,3'-dialkylthiatricarbocyanines, thiatricarbocyanines (especially with rigidized chains), selenotricarbocyanines, and enamine tricarbocyanines.

Preferred classes of dyes according to the present invention are represented by the following general formula (I) or (II):

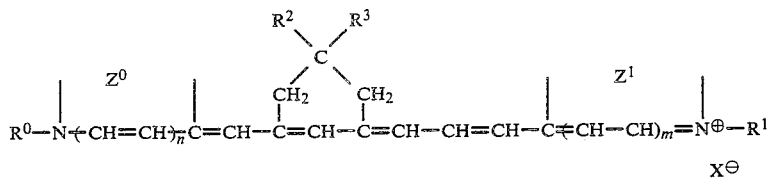

I

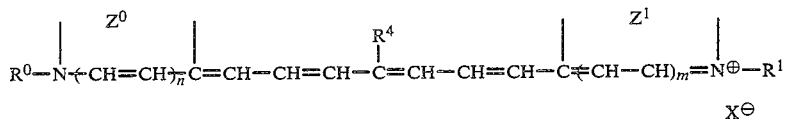

II

Poly(ethylacrylate) is of course a well known polymeric material available commercially from numerous sources.

These type of compounds are added to the optically sensitized emulsions in any of the conventional methods by which supersensitizers or other adjuvants are added to photographic emulsions. Typically the supersensitizing compounds of the present invention are added into the emulsion mixture just prior to coating, mixed well, then coated onto the photographic substrate. The compounds are added as aqueous solutions, aqueous dispersions, or organic solvent solutions (e.g., methanol) alone, or with other desirable adjuvants.

wherein:

$R^0$ and $R^1$ can be a substituted alkyl group or a nonsubstituted alkyl having from 1 to 8 carbon atoms such as, for example, methyl, ethyl, propyl, butyl, amyl, benzyl, octyl, carboxymethyl, carboxyethyl, sulfopropyl, carboxypropyl, carboxybutyl, sulfoethyl, sulfoisopropyl and sulfobutyl groups;

$X^-$ is any acid anion such as, for example, chloride, bromide, iodide, perchlorate, sulfamate, thiocyanate, p-toluenesulfonate and benzenesulfonate;

$Z^0$ and $Z^1$ are independently the non-metallic atoms necessary to complete an aromatic heterocyclic nucleus chosen within those of the thiazole series, benzothiazole series, [1,2-d]-naphthothiazole series, [2,1-d]-naphthothiazole series, oxazole series, benzoxazole series, selenazole series, benzoselenazole series, [1,2-d]-naphthoselenazole series, [2,1-d]-naphthoselenazole series, thiazoline series, 4-quinoline series, 2-pyridine series, 4-pyridine series, 3,3-dialkyl-indolenine series (wherein alkyl has a meaning known to those skilled in the art including alkyl groups having 1 to 12 carbon atoms), imidazole series and benzimidazole series.

More particularly and preferably, the present invention refers to dyes of the type above indicated in which both heterocyclic nuclei are of the benzothiazole series.

$R^2$ and $R^3$ each represents a hydrogen atom, or an alkyl group having 1 to 5 carbon atoms such as a methyl group or an ethyl group; $R^4$ represents a hydrogen atom, a halogen atom, a hydroxy group, a carboxy group, an alkyl group having 1 to 5 carbon atoms, an unsubstituted or substituted aryl group, or an acyloxy group shown by $$-\overset{\overset{\displaystyle O}{\|}}{C}-O-R^5$$

wherein $R^5$ represents an alkyl group having 1 to 5 carbon atoms, a phenyl group, or a substituted phenyl group.

Silver halide emulsions supersensitized in accordance with this invention can comprise silver chloride, silver bromide, silver bromoiodide, silver chloroiodide, silver chlorobromoiodide or mixtures thereof. Such emulsions can be coarse, medium or fine grain (or mixtures thereof) and can be prepared by any of the well-known procedures, e.g., single jet emulsions or double jet emulsions. Useful emulsions include Lippmann emulsions, ammoniacal emulsions, thiocyanate or thioether ripened emulsions such as those described in Nietz et al., U.S. Pat. No. 2,222,264, Illingsworth, U.S. Pat. No. 3,320,069, and McBride, U.S. Pat. No. 3,271,157; or, cubic grain emulsions, such as those described by Kline and Moisar, Journal of Photographic Science, volume 12, page 242 et seq. or Markocki, The Spectral Sensitization of Silver Bromide Emulsions on Different Crystallographic Faces, Journal of Photographic Science, volume 13, 1965; or Illingsworth, British Pat, No. 1,156,193 published June 25, 1969.

Tabular or lamellar grain emulsions as described in U.S. Pat. Nos. 4,425,425 and 4,425,426 are also equally useful.

The silver halide emulsions supersensitized with the dyes of this invention can be unwashed or washed to remove soluble salts. In the latter case the soluble salts can be removed by chill-setting and leaching or the emulsion can be coagulation washed e.g., by the procedures described in Hewitson et al., U.S. Pat. No. 2,618,556; Yutzy et al., U.S. Pat. No. 2,614,928; Yackel, U.S. Pat. No. 2,565,418; Hart et al., U.S. Pat. No. 3,241,969; and Waller et al., U.S. Pat. No. 2,489,341.

Photographic emulsions containing supersensitizing combinations in accordance with this invention can be sensitized with chemical sensitizers, such as with reducing agents; sulfur, selenium or tellurium compounds; gold, platinum or palladium compounds; or combinations of these. Suitable chemical sensitization procedures are described in Shepard, U.S. Pat. No. 1,623,499; Waller, U.S. Pat. No. 2,399,083; McVeigh, U.S. Pat. No. 3,297,447; and Dunn, U.S. Pat. No. 3,297,446.

The supersensitized silver halide emulsions of this invention can contain speed increasing compounds such as polyalkylene glycols, cationic surface active agents and thioethers or combinations of these as described in Piper, U.S. Pat. No. 2,886,437; Chechak, U.S. Pat. No. 3,046,134; Carroll et al., U.S. Pat. No. 2,944,900; and Goffe, U.S. Pat. No. 3,294,540.

Silver halide emulsions containing the supersensitizing combinations of this invention can be protected against the production of fog and can be stabilized against loss of sensitivity during keeping. Suitable antifoggants and stabilizers which can be used alone or in combination, include the thiazolium salts described in Staud, U.S. Pat. No. 2,131,038 and Allen, U.S. Pat. No. 2,694,716; the azaindenes described in Piper, U.S. Pat. No. 2,886,437 and Heimbach, U.S. Pat. No. 2,444,605; the mercury salts described in Allen, U.S. Pat. No. 2,728,663; the urazoles described in Anderson, U.S. Pat. No. 3,287,135; the sulfocatechols described in Kennard, U.S. Pat. No. 3,235,652; the oximes described in Carroll et al, British Pat. No. 623,448; nitron; nitroindazoles; the polyvalent metal salts described in Jones, U.S. Pat. No. 2,839,405; the thiuronium salts described in Herz, U.S. Pat. No. 3,220,839; and the palladium, platinum and gold salts described in Trivelli, U.S. Pat. No. 2,566,263 and Damschroder, U.S. Pat. No. 2,597,915.

Photographic elements including emulsions supersensitized in accordance with this invention can contain incorporated developing agents such as hydroquinones, catechols, aminophenols, 3-pyrazolidones, ascorbic acid and its derivatives, reductones and phenylenediamines, or combinations of developing agents. The developing agents can be in the silver halide emulsion and/or in another suitable location in the photographic element. The developing agents can be added from suitable solvents or in the form of dispersions as described in Yackel, U.S. Pat. No. 2,592,368 and Dunn et al., French Pat. No. 1,505,778.

Silver halide supersensitized in accordance with the invention can be dispersed in colloids that can be hardened by various organic or inorganic hardeners, alone or in combination, such as the aldehydes, and blocked aldehydes, ketones, carboxylic and carbonic acid derivatives, sulfonate esters, sulfonyl halides and vinyl sulfones, active halogen compounds, epoxy compounds, aziridines, active olefins, isocyanates, carbodiimides, mixed function hardeners and polymeric hardeners such as oxidized polysaccharides, e.g., dialdehyde starch, oxyguargum, etc.

Photographic emulsions supersensitized with the materials described herein can contain various colloids alone or in combination as vehicles or binding agents. Suitable hydrophilic materials include both naturally-occurring substances such as proteins, for example, gelatin, gelatin derivatives (e.g., phthalated gelatin), cellulose derivatives, polysaccharides such as dextran, gum arabic and the like; and synthetic polymeric substances such as water soluble polyvinyl compounds, e.g., poly(vinylpyrrolidone) acrylamide polymers or other synthetic polymeric compounds such as dispersed vinyl compounds in latex form, and particularly those which increase the dimensional stability of the photographic materials. Suitable synthetic polymers include those described, for example, in U.S. Pat. Nos. 3,142,568 of Nottorf; 3,193,386 of White; 3,062,674 of Houck, Smith and Yudelson; 3,220,844 of Houck, Smith and Yudelson; Ream and Fowler, 3,287,289; and Dykstra, U.S. Pat. No. 3,411,911; particularly effective are those water-insoluble polymers of alkyl acrylates and methacrylates, acrylic acid, sulfoalkyl acrylates or methacrylates, those which have cross linking sites which facilitate hardening or curing and those having recurring sulfobetaine units as described in Canadian Pat. No. 774,054.

Emulsions supersensitized in accordance with this invention can be used in photographic elements which contain antistatic or conducting layers, such as layers that comprise soluble salts, e.g., chlorides, nitrates, etc., evaporated metal layers, ionic polymers such as those described in Minsk, U.S. Pat. Nos. 2,861,056 and 3,206,312 or insoluble inorganic salts such as those described in Trevoy, U.S. Pat. No. 3,428,451.

Photographic emulsions containing the supersensitizing combinations of the invention can be coated on a wide variety of supports. Typical supports include polyester film, subbed polyester film, poly(ethylene terephthalate) film, cellulose nitrate film, cellulose ester film, poly(vinyl acetal) film, polycarbonate film and related films or resinous materials, as well as glass, paper, metal and the like. Typically, a flexible support is employed, especially a paper support, which can be partially acetylated or coated with baryta and/or an alpha-olefin polymer, particularly a polymer of an alpha-olefin containing 2 to 10 carbon atoms such as polyethylene, polypropylene, ethylenebutene copolymers and the like.

Supersensitized emulsions of the invention can contain plasticizers and lubricants such as polyalcohols, e.g., glycerin and diols of the type described in Milton, U.S. Pat. No. 2,960,404; fatty acids or esters such as those described in Robijns, U.S. Pat. No. 2,588,765 and Duane, U.S. Pat. No. 3,121,060; and silicone resins such as those described in DuPont British Pat. No. 955,061.

The photographic emulsions supersensitized as described herein can contain surfactants such as saponin, anionic compounds such as the alkylarylsulfonates described in Baldsiefen, U.S. Pat. No. 2,600,831 fluorinated surfactants, and amphoteric compounds such as those described in Ben-Ezra, U.S. Pat. No. 3,133,816.

Photographic elements containing emulsion layers sensitized as described herein can contain matting agents such as starch, titanium dioxide, zinc oxide, silica, polymeric beads including beads of the type described in Jelley et al, U.S. Pat. No. 2,992,101 and Lynn, U.S. Pat. No. 2,701,245.

Spectrally sensitized emulsions of the invention can be utilized in photographic elements which contain brightening agents including stilbene, triazine, oxazole and coumarin brightening agents. Water soluble brightening agents can be used such as those described in Albers et al., German Pat. No. 972,067 and McFall et al., U.S. Pat. No. 2,933,390 or dispersions of brighteners can be used such as those described in Jansen, German Pat. No. 1,150,274 and Oetiker et al., U.S. Pat. No. 3,406,070.

Photographic elements containing emulsion layers supersensitized according to the present invention can be used in photographic elements which contain light absorbing materials and filter dyes such as those described in Sawdey, U.S. Pat. No. 3,253,921; Gaspar, U.S. Pat. No. 2,274,782; Carroll et al., U.S. Pat. No. 2,527,583 and Van Campen, U.S. Pat. No. 2,956,879. If desired, the dyes can be mordanted, for example, as described in Milton and Jones, U.S. Pat. No. 3,282,699.

The sensitizing dyes and/or supersensitizers (and other emulsion addenda) can be added to the photographic emulsions from water solution or suitable organic solvent solutions, for example with the procedure described in Collins et al., U.S. Pat. No. 2,912,343; Owens et al., U.S. Pat. No. 3,342,605; Audran, U.S. Pat. No. 2,996,287 or Johnson et al., U.S. Pat. No. 3,425,835. The dyes can be dissolved separately or together, and the separate or combined solutions can be added to a silver halide emulsion, or a silver halide emulsion layer can be bathed in the solution of supersensitizers and/or dyes.

Contrast enhancing additives such as hydrazines, rhodium, irridium and combinations thereof are also useful.

Photographic emulsions of this invention can be coated by various coating procedures including dip coating, air knife coating, curtain coating, or extrusion coating using hoppers of the type described in Beguin, U.S. Pat. No. 2,681,294. If desired, two or more layers may be coated simultaneously by the procedures described in Russell, U.S. Pat. No. 2,761,791 and Wynn British Pat. No. 837,095.

Silver halide emulsions containing the supersensitizer combinations of this invention can be used in elements designed for color photography, for example, elements containing color-forming couplers such as those described in Frolich et al., U.S. Pat. No. 2,376,679; Vittum et al., U.S. Pat. No. 2,322,027; Fierke et al., U.S. Pat. No. 2,801,171; Godowsky, U.S. Pat. No. 2,698,794; Barr et al., U.S. Pat. No. 3,227,554 and Graham, U.S. Pat. No. 3,046,129; or elements to be developed in solutions containing color-forming couplers such as those described in Mannes and Godowsky, U.S. Pat. No. 2,252,718; Carroll et al. U.S. Pat. No. 2,592,243 and Schwan, U.S. Pat. No. 2,950,970.

Exposed photographic emulsions of this invention can be processed by various methods including processing in alkaline solutions containing conventional developing agents such as hydroquinones, catechols, aminophenols, 3-pyrazolidones, phenylenediamines, ascorbic acid derivatives, hydroxylamines, hydrazines and the like; web processing such as described in Tegillus et al., U.S. Pat. No. 3,179,517; stabilization processing as described in Yackel et al. "Stabilization Processing of Films and Papers", PSA Journal, vol. 16B, Aug. 1950; monobath processing as described in Levy "Combined Development and fixation of Photographic Images with Monobaths", Phot, Sci. and Eng., vol. 2, No. 3, Oct. 1958, and Barnes et al. U.S. Pat. No. 3,392,019. If desired, the photographic emulsions of this invention can be processed in hardening developers such as those described in Allen et al., U.S. Pat. No. 3,232,761; in roller transport processors such as those described in Russell, U.S. Pat. No. 3,025,779; or by surface application processing as described in Example 3, of Kitze, U.S. Pat. No. 3,418,132.

These and other aspects of the invention will be shown by the Examples.

Two different emulsions are used in the various examples to show the practice of the present invention. Emulsion A was prepared by a double jet precipitation to provide an emulsion with 64% chloride and 36% bromide with an average grain size of 0.24 micrometers. The emulsion was divided in half for two different types of chemical sensitization. Emulsion Aa was digested with sodium thiosulfate while Ab was digested with p-toluenesulfinic acid, sodium thiosulfate and sodium gold tetrachloride ($NaAuCl_4$).

Emulsion B is an ammoniacal iodobromide emulsion made by double jet precipitation with all potassium iodide and ammonia in the kettle before precipitation. The resulting emulsion was 3% iodide and 97% bromide with an average grain size of 0.24 micrometers. The emulsion was then chemically digested with sulfur and gold.

Final preparation of the emulsions comprised the addition of water and gelatin to a level of 5.0% gelatin and 2500 g of emulsion per mole of silver. The pH was adjusted to 7.0, and the pAg was adjusted to 7.2. Infrared sensitizing dyes were added as 0.04% by weight solutions in methanol. Phenylmercaptotetrazole (hereinafter PMT) was added as a 0.1% methanol solution, poly(ethylacrylate) (hereinafter PEA) as a 20% aqueous dispersion and Leucophor BCF (hereinafter BCF) as a 1% aqueous solution. Formaldehyde hardener and any other indicated materials were added before coating as an aqueous solution.

EXAMPLES 1-8

The effect of various individual and combinations of additives on photographic silver halide emulsions were investigated. Emulsion Ab (the sulfur and gold digested chlorobromide emulsion) was dyed with the infrared sensitizing dye shown below. The coated and dried film was aged one week before exposing on a sensitometer for $10^{-3}$ seconds through a Huoy cut-off filter which filtered out all radiation below 760 nm. The exposed films were developed in a 90 second X-ray processor. Sensitometric results included $D_{min}$, $D_{max}$, speed (at O.D.=0.25), average contrast ($\bar{C}$), change in speed from emulsion without additives (dS), and the percent that change (ds) represented (% dS). Sensitometric evaluation was also run on samples incubated for three days at 50° C. and 40% R.H. The amounts of PMT, BCF and PEA are presented in grams per mole of silver. The results are shown in Table I for emulsion Ab.

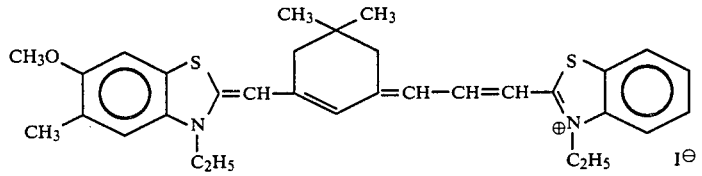

(I)

TABLE I

| | Additives | | | Fresh | | | | | | Incubated | | | | |
|---|---|---|---|---|---|---|---|---|---|---|---|---|---|---|
| Ex | PMT | BCF | PEA | Dmin | Dmax | S | C | dS | % dS | Dmin | Dmax | S | C | −dS |
| 1 | 0 | 0 | 0 | 0.04 | 3.31 | 1.41 | 3.19 | — | 100 | 0.05 | 3.27 | 1.39 | 3.03 | 0.02 |
| 2 | 0.038 | 0 | 0 | 0.04 | 3.38 | 1.80 | 3.22 | 0.39 | 245 | 0.05 | 3.27 | 1.68 | 2.90 | 0.12 |
| 3 | 0 | 0.50 | 0 | 0.04 | 3.38 | 1.67 | 3.17 | 0.26 | 182 | 0.05 | 3.25 | 1.54 | 2.89 | 0.13 |
| 4 | 0 | 0 | 30 | 0.04 | 3.31 | 1.55 | 3.18 | 0.14 | 138 | 0.05 | 3.21 | 1.52 | 2.93 | 0.03 |
| 5 | 0.038 | 0.50 | 0 | 0.04 | 3.38 | 1.76 | 3.16 | 0.36 | 229 | 0.05 | 3.31 | 1.64 | 2.96 | 0.12 |
| 6 | 0.038 | 0 | 30 | 0.04 | 3.40 | 1.86 | 3.29 | 0.45 | 282 | 0.05 | 3.09 | 1.73 | 2.89 | 0.13 |
| 7 | 0 | 0.50 | 30 | 0.04 | 3.20 | 1.90 | 3.07 | 0.49 | 309 | 0.05 | 3.22 | 1.84 | 2.96 | 0.06 |
| 8 | 0.038 | 0.50 | 30 | 0.04 | 3.33 | 1.96 | 3.16 | 0.55 | 355 | 0.05 | 3.17 | 1.88 | 2.98 | 0.08 |

The data show each additive, PMT, BCF and PEA, is an efficient supersensitizer. However, the maximum sensitivity (speed) is obtained by an additive effect when combining PMT, BCF and PEA in the same coating.

EXAMPLES 9-16

Examples 1-8 were repeated on the sulfur digested chlorobromide emulsion (Aa) with that the same infrared spectral sensitizing dye (I). The results are reported in Table II.

TABLE II

| | Additives | | | Fresh | | | | | | Incubated | | | | |
|---|---|---|---|---|---|---|---|---|---|---|---|---|---|---|
| Ex | PMT | BCF | PEA | Dmin | Dmax | S | C | dS | % dS | Dmin | Dmax | S | C | −dS |
| 9 | 0 | 0 | 0 | 0.04 | 3.67 | 1.32 | 2.38 | — | 100 | 0.04 | 3.55 | 1.30 | 2.25 | 0.02 |
| 10 | 0.038 | 0 | 0 | 0.04 | 3.90 | 1.58 | 2.41 | 0.26 | 182 | 0.04 | 3.74 | 1.52 | 2.26 | 0.06 |
| 11 | 0 | 0.50 | 0 | 0.04 | 3.88 | 1.57 | 2.37 | 0.25 | 179 | 0.04 | 3.67 | 1.50 | 2.30 | 0.07 |
| 12 | 0 | 0 | 30 | 0.04 | 3.59 | 1.37 | 2.41 | 0.05 | 112 | 0.04 | 3.43 | 1.35 | 2.28 | 0.02 |
| 13 | 0.038 | 0.50 | 0 | 0.04 | 3.88 | 1.62 | 2.39 | 0.30 | 200 | 0.04 | 3.73 | 1.54 | 2.21 | 0.08 |
| 14 | 0.038 | 0 | 30 | 0.04 | 3.84 | 1.58 | 2.51 | 0.26 | 182 | 0.04 | 3.50 | 1.55 | 2.37 | 0.03 |
| 15 | 0 | 0.50 | 30 | 0.04 | 3.92 | 1.73 | 2.44 | 0.41 | 257 | 0.04 | 3.63 | 1.65 | 2.16 | 0.08 |
| 16 | 0.038 | 0.50 | 30 | 0.04 | 3.85 | 1.77 | 2.36 | 0.45 | 282 | 0.04 | 3.66 | 1.70 | 2.25 | 0.07 |

EXAMPLES 17-24

Examples 1-8 were repeated except that Emulsion B, the sulfur and gold digested, ammoniacal iodobromide emulsion, was used with the same infrared sensitizing dye (I). The results are reported in Table III.

TABLE III

| | Additives | | | Fresh | | | | | | Incubated | | | | |
|---|---|---|---|---|---|---|---|---|---|---|---|---|---|---|
| Ex | PMT | BCF | PEA | Dmin | Dmax | S | C | dS | % dS | Dmin | Dmax | S | C | −dS |
| 17 | 0 | 0 | 0 | 0.04 | 3.19 | 1.29 | 2.97 | — | 100 | 0.04 | 3.07 | 1.23 | 2.96 | 0.06 |
| 18 | 0.038 | 0 | 0 | 0.04 | 3.17 | 1.61 | 3.10 | 0.32 | 209 | 0.04 | 3.12 | 1.54 | 2.97 | 0.07 |
| 19 | 0 | 0.50 | 0 | 0.03 | 3.15 | 1.39 | 3.00 | 0.10 | 126 | 0.04 | 3.09 | 1.34 | 2.93 | 0.05 |
| 20 | 0 | 0 | 30 | 0.03 | 3.01 | 1.44 | 3.05 | 0.15 | 141 | 0.03 | 2.90 | 1.36 | 2.83 | 0.08 |

TABLE III-continued

| | Additives | | | Fresh | | | | | | Incubated | | | | |
|---|---|---|---|---|---|---|---|---|---|---|---|---|---|---|
| Ex | PMT | BCF | PEA | Dmin | Dmax | S | C | dS | % dS | Dmin | Dmax | S | C | −dS |
| 21 | 0.038 | 0.50 | 0 | 0.03 | 3.12 | 1.61 | 3.02 | 0.32 | 209 | 0.04 | 3.10 | 1.56 | 2.98 | 0.05 |
| 22 | 0.038 | 0 | 30 | 0.03 | 3.02 | 1.69 | 2.99 | 0.40 | 251 | 0.03 | 2.92 | 1.62 | 2.79 | 0.07 |
| 23 | 0 | 0.50 | 30 | 0.03 | 2.98 | 1.60 | 2.88 | 0.31 | 204 | 0.04 | 2.89 | 1.53 | 2.78 | 0.07 |
| 24 | 0.038 | 0.50 | 30 | 0.03 | 3.04 | 1.79 | 3.02 | 0.50 | 316 | 0.04 | 2.90 | 1.71 | 2.81 | 0.08 |

EXAMPLES 25-32

Examples 1-8 were repeated on emulsion Ab, the sulfur and gold digested, chlorobromide emulsion, except that the infrared sensitizing dye:

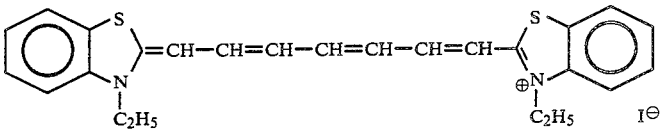

was used. The results are reported in Table IV.

TABLE IV

| | Additives | | | Fresh | | | | | | Incubated | | | | |
|---|---|---|---|---|---|---|---|---|---|---|---|---|---|---|
| Ex | PMT | BCF | PEA | Dmin | Dmax | S | C | dS | % dS | Dmin | Dmax | S | C | −dS |
| 25 | 0 | 0 | 0 | 0.03 | 3.25 | 1.17 | 3.26 | — | 100 | 0.04 | 3.18 | 1.13 | 3.10 | 0.04 |
| 26 | 0.038 | 0 | 0 | 0.03 | 3.30 | 1.40 | 3.23 | 0.23 | 170 | 0.04 | 3.22 | 1.13 | 3.12 | 0.27 |
| 27 | 0 | 0.50 | 0 | 0.04 | 3.32 | 2.01 | 3.13 | 0.84 | 692 | 0.05 | 3.25 | 1.96 | 3.01 | 0.05 |
| 28 | 0 | 0 | 30 | 0.03 | 3.17 | 1.36 | 3.31 | 0.19 | 155 | 0.04 | 3.14 | 1.32 | 3.14 | 0.04 |
| 29 | 0.038 | 0.50 | 0 | 0.04 | 3.41 | 1.91 | 3.20 | 0.74 | 550 | 0.04 | 3.17 | 1.71 | 3.03 | 0.20 |
| 30 | 0.038 | 0 | 30 | 0.03 | 3.25 | 1.66 | 3.21 | 0.49 | 309 | 0.04 | 3.21 | 1.39 | 3.13 | 0.27 |
| 31 | 0 | 0.50 | 30 | 0.03 | 3.38 | 2.07 | 3.20 | 0.90 | 794 | 0.04 | 3.19 | 2.02 | 2.98 | 0.05 |
| 32 | 0.038 | 0.50 | 30 | 0.03 | 3.20 | 2.10 | 3.18 | 0.91 | 851 | 0.04 | 3.07 | 1.99 | 2.99 | 0.11 |

I claim:

1. A silver halide photographic emulsion in a hydrophilic colloidal binder, said emulsion being spectrally sensitized to the infrared portion of the electromagnetic spectrum and having a supersensitizing amount of a supersensitizing combination selected from the group consisting of (1) an arylmercaptotetrazole and poly(ethylacrylate), (2) an arylmercaptotetrazole and a bis(triazine-2-ylamino)stilbene, and (3) an arylmercaptotetrazole, a bis(triazine-2-ylamino)stilbene, and poly(ethylacrylate).

2. The emulsion of claim 1 containing an arylmercaptotetrazole wherein said arylmercaptotetrazole is represented by the formula

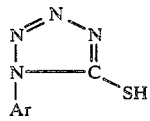

wherein Ar represents a substituted or unsubstituted phenyl group.

3. The emulsion of claim 2 wherein said aryl group comprises a phenyl radical or a phenyl radical with a substituent selected from the group consisting of alkyl, alkoxy, phenyl, fused benzyl, halogen, amino, sulfonic acid, and carboxyl.

4. The emulsion of claim 1 containing a bis(triazine-2-ylamino)stilbene wherein said bis(triazine-2-ylamino)-stilbene is represented by the formula

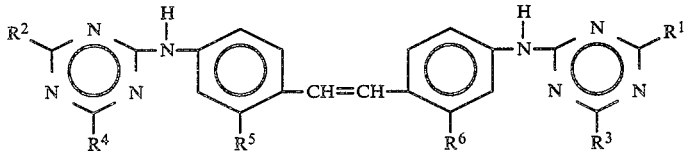

wherein $R^1$, $R^2$, $R^3$ and $R^4$ are selected from H, OH, alkoxy, aryloxy, amino, arylamino, β-hydroxyethylamino and halogen, $R^5$ and $R^6$ are acid, water-solubilizing groups.

5. The emulsion of claim 2 containing a bis(triazine-2-ylamino)stilbene wherein said bis(triazine-2-ylamino)-stilbene is represented by the formula

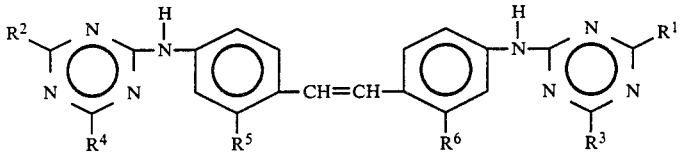

wherein $R^1$, $R^2$, $R^3$ and $R^4$ are selected from H, OH, alkoxy, aryloxy, amino, arylamino, β-hydroxyethylamino and halogen, $R^5$ and $R^6$ are acid, water-solubilizing groups.

6. The emulsion of claim 3 containing a bis(triazine-2-ylamino)stilbene wherein said bis(triazine-2-ylamino)-stilbene is represented by the formula

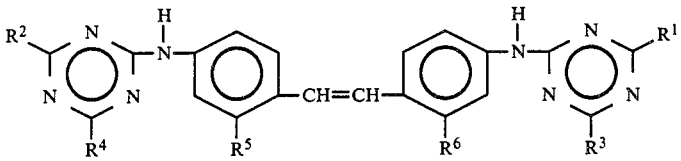

wherein $R^1$, $R^2$, $R^3$ and $R^4$ are selected from H, OH, alkoxy, aryloxy, amino, arylamino, β-hydroxyethylamino and halogen, $R^5$ and $R^6$ are acid, water-solubilizing groups.

7. The element of claim 4 wherein $R^1$ and $R^2$ are hydroxyl and $R^3$ and $R^4$ are anilino.

8. The element of claim 5 wherein $R^1$ and $R^2$ are hydroxyl and $R^3$ and $R^4$ are anilino.

9. The element of claim 6 wherein $R^1$ and $R^2$ are hydroxyl and $R^3$ and $R^4$ are anilino.

10. The element of claim 4 wherein $R^5$ and $R^6$ are sulfonic acid or sulfonic acid alkali salt.

11. The element of claim 7 wherein $R^5$ and $R^6$ are sulfonic acid or sulfonic acid alkali salt.

12. The element of claim 8 wherein $R^5$ and $R^6$ are sulfonic acid or sulfonic acid alkali salt.

13. The element of claim 9 wherein $R^5$ and $R^6$ are sulfonic acid or sulfonic acid alkali salt.

14. The element of claim 7 wherein the supersensitizer combination is selected from the group consisting of (1) phenylmercaptotetrazole, and poly(ethylacrylate), (2) phenylmercaptotetrazole and a bis(triazine-2-ylamino)stilbene, and (3) phenylmercaptotetrazole, poly(ethylacrylate) and a bis(triazine-2-ylamino)stilbene.

15. The element of claim 10 wherein the supersensitizer combination is selected from the group consisting of (1) phenylmercaptotetrazole, and poly(ethylacrylate), (2) phenylmercaptotetrazole and a bis(triazine-2-ylamino)stilbene, and (3) phenylmercaptotetrazole, poly(ethylacrylate) and a bis(triazine-2-ylamino)stilbene.

16. The element of claim 11 wherein the supersensitizer combination is selected from the group consisting of (1) phenylmercaptotetrazole, and poly(ethylacrylate), (2) phenylmercaptotetrazole and a bis(triazine-2-ylamino)stilbene, and (3) phenylmercaptotetrazole, poly(ethylacrylate) and a bis(triazine-2-ylamino)stilbene.

17. The element of claim 12 wherein the supersensitizer combination is selected from the group consisting of (1) phenylmercaptotetrazole, and poly(ethylacrylate), (2) phenylmercaptotetrazole and a bis(triazine-2-ylamino)stilbene, and (3) phenylmercaptotetrazole, poly(ethylacrylate) and a bis(triazine-2-ylamino)stilbene.

18. The element of claim 13 wherein the supersensitizer combination is selected from the group consisting of (1) phenylmercaptotetrazole, and poly(ethylacrylate), (2) phenylmercaptotetrazole and a bis(triazine-2-ylamino)stilbene, and (3) phenylmercaptotetrazole, poly(ethylacrylate) and a bis(triazine-2-ylamino)stilbene.

19. The element of claim 1 wherein said emulsion is sensitized by a dye selected from the class consisting of thia-, benzothia-, seleno-, benzoseleno-, imida-, benzoimida-, oxa-, benzoxa-, and enamine tricarbocyanines.

20. The element of claim 2 wherein said emulsion is sensitized by a dye selected from the class consisting of thia-, benzothia-, seleno-, benzoseleno-, imida-, benzoimida-, oxa-, benzoxa-, and enamine tricarbocyanines.

21. The element of claim 5 wherein said emulsion is sensitized by a dye selected from the class consisting of thia-, benzothia-, seleno-, benzoseleno-, imida-, benzoimida-, oxa-, benzoxa-, and enamine tricarbocyanines.

22. The element of claim 11 wherein said emulsion is sensitized by a dye selected from the class consisting of thia-, benzothia-, seleno-, benzoseleno-, imida-, benzoimida-, oxa-, benzoxa-, and enamine tricarbocyanines.

23. The element of claim 14 wherein said emulsion is sensitized by a dye selected from the class consisting of thia-, benzothia-, seleno-, benzoseleno-, imida-, benzoimida-, oxa-, benzoxa-, and enamine tricarbocyanines.

24. The element of claim 15 wherein said emulsion is sensitized by a dye selected from the class consisting of thia-, benzothia-, seleno-, benzoseleno-, imida-, benzoimida-, oxa-, benzoxa-, and enamine tricarbocyanines.

25. The element of claim 5 comprising said arylmercaptotetrazole, said bis(triazine-2-ylamino)stilbene, and poly(ethylacrylate).

26. A silver halide photographic emulsion in a hydrophilic colloidal binder, said emulsion being spectrally sensitized to the infrared portion of the electromagnetic spectrum and having a supersensitizing amount of a supersensitizing combination selected from the group consisting of (1) an arylmercaptotetrazole and poly(ethylacrylate), (2) an arylmercaptotetrazole and a bis(triazine-2-ylamino)stilbene, (3) poly(ethylacrylate) and a bis(triazine-2-ylamino)-stilbene, and (4) an arylmercaptotetrazole, a bis(triazine-2-ylamino)stilbene, and poly(ethylacrylate).

27. The emulsion of claim 26 containing a bis(triazine-2-ylamino)stilbene wherein said bis(triazine-2-ylamino)-stilbene is represented by the formula

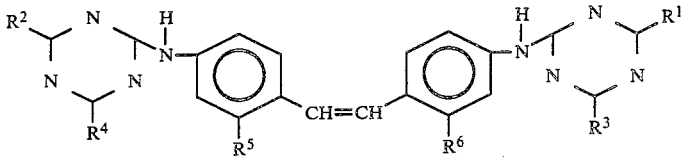

wherein $R^1$, $R^2$, $R^3$ and $R^4$ are selected from H, OH, alkoxy, aryloxy, amino, arylamino, $\beta$-hydroxyethylamino and halogen, $R^5$ and $R^6$ are acid, water-solubilizing groups.

28. The element of claim 26 wherein said emulsion is sensitized by a dye selected from the class consisting of thia-, benzothia,-, seleno-, benzoseleno-, imida-, benzoimida-, oxa-, benzoxa-, and enamine tricarbocyanines.

29. The element of claim 27 wherein said emulsion is sensitized by a dye selected from the class consisting of thia-, benzothia,-, seleno-, benzoseleno-, imida-, benzoimida-, oxa-, benzoxa-, and enamine tricarbocyanines.

* * * * *